US012471628B2

(12) United States Patent
Hepworth et al.

(10) Patent No.: US 12,471,628 B2
(45) Date of Patent: Nov. 18, 2025

(54) CONTAINER FOR AN AEROSOL PROVISION DEVICE

(71) Applicant: NICOVENTURES TRADING LIMITED, London (GB)

(72) Inventors: Richard Hepworth, Southampton (GB); Andrew Davis, London (GB); John Major, London (GB); Caner Yurteri, London (GB); Dominic Woodcock, London (GB); Colin Dickens, London (GB)

(73) Assignee: NICOVENTURES TRADING LIMITED, London (GB)

( * ) Notice: Subject to any disclaimer, the term of this patent is extended or adjusted under 35 U.S.C. 154(b) by 260 days.

(21) Appl. No.: 16/333,565

(22) PCT Filed: Sep. 13, 2017

(86) PCT No.: PCT/EP2017/073057
§ 371 (c)(1),
(2) Date: Mar. 14, 2019

(87) PCT Pub. No.: WO2018/050717
PCT Pub. Date: Mar. 22, 2018

(65) Prior Publication Data

US 2019/0254343 A1 Aug. 22, 2019

(30) Foreign Application Priority Data

Sep. 14, 2016 (GB) ..... 1615608

(51) Int. Cl.
*A24F 40/30* (2020.01)
*A24B 15/167* (2020.01)
(Continued)

(52) U.S. Cl.
CPC ..... *A24F 40/30* (2020.01); *A24B 15/167* (2016.11); *A24D 3/061* (2013.01); *A24F 7/02* (2013.01);
(Continued)

(58) Field of Classification Search
CPC ..... A24D 1/002; A24D 1/22; A24D 3/061; A24D 1/20; A24B 15/167; A24B 15/12;
(Continued)

(56) References Cited

U.S. PATENT DOCUMENTS 3,033,209 A 5/1962 Toney
3,370,592 A 2/1968 Schultz et al.
(Continued)

FOREIGN PATENT DOCUMENTS

AR 089648 A1 9/2014
AR 091949 A1 3/2015
(Continued)

OTHER PUBLICATIONS

International Search Report and Written Opinion, Application No. PCT/EP2017/073057, mailed Feb. 7, 2018, 16 pages.
(Continued)

*Primary Examiner* — Michael H. Wilson
*Assistant Examiner* — Stephanie Lynn Moore
(74) *Attorney, Agent, or Firm* — Merchant & Gould P.C.

(57) ABSTRACT

There is described a container for an aerosol provision device for providing an inhalable medium comprising an aerosol, the container including a first section and second and third sections either side of the first section, wherein the first section and the second and third sections each includes a respective material that permits the aerosol generated in the device to flow into and through the container. A first substance is distributed in the material of the first section, the first substance for modifying a property of the aerosol
(Continued)

when the aerosol flows through the container. The material of at least one of the second and third sections is substantially free of the first substance and acts as a barrier to prevent first substance exiting the container.

19 Claims, 4 Drawing Sheets

(51) Int. Cl.

| | |
|---|---|
| ***A24D 3/06*** | (2006.01) |
| ***A24F 7/02*** | (2006.01) |
| ***A24F 40/10*** | (2020.01) |
| ***A24F 40/20*** | (2020.01) |
| ***A24F 40/42*** | (2020.01) |

(52) U.S. Cl.
CPC ..... *A24F 40/42* (2020.01); *A24F 40/10* (2020.01); *A24F 40/20* (2020.01)

(58) Field of Classification Search
CPC . A24B 3/14; A24F 40/20; A24F 40/10; A24F 40/40; A24F 40/30; A24F 40/42
See application file for complete search history.

(56) References Cited

U.S. PATENT DOCUMENTS 3,894,544 A * 7/1975 Egri ..... A24B 3/14 131/370
4,145,518 A 3/1979 Morie et al.
4,181,640 A 1/1980 Morie et al.
4,188,960 A 2/1980 Morie et al.
4,338,931 A 7/1982 Cavazza
4,714,082 A 12/1987 Banerjee et al.
5,099,861 A 3/1992 Clearman et al.
5,392,793 A 2/1995 Molloy
5,632,287 A 5/1997 Hayworth et al.
6,382,465 B1 5/2002 Greiner-Perth
6,532,965 B1 * 3/2003 Abhulimen ..... A24F 42/60 131/194
6,606,992 B1 8/2003 Schuler et al.
6,705,313 B2 3/2004 Niccolai
6,708,846 B1 3/2004 Fuchs et al.
7,726,320 B2 6/2010 Robinson et al.
8,051,857 B1 11/2011 Baptiste
8,377,009 B2 2/2013 Sullivan et al.
8,499,766 B1 8/2013 Newton
8,997,753 B2 4/2015 Li et al.
8,997,754 B2 4/2015 Tucker et al.
9,004,073 B2 4/2015 Tucker
9,247,773 B2 2/2016 Memari et al.
9,282,772 B2 3/2016 Tucker et al.
9,693,587 B2 7/2017 Plojoux et al.
10,010,687 B2 7/2018 Von Schuckmann
10,015,990 B2 7/2018 Mironov
10,172,390 B2 1/2019 Nakano et al.
10,368,583 B2 8/2019 Takeuchi et al.
10,426,199 B2 10/2019 Turner et al.
10,470,491 B2 11/2019 Sutton et al.
10,492,526 B2 12/2019 Sampson et al.
10,758,686 B2 9/2020 Reevell
2004/0173229 A1 9/2004 Crooks et al.
2005/0000518 A1 1/2005 Dunkley et al.
2005/0016533 A1 1/2005 Schuler et al.
2005/0022813 A1 2/2005 Alston
2005/0048003 A1 3/2005 Ohki et al.
2005/0056280 A1 3/2005 Alston et al.
2005/0066981 A1 3/2005 Crooks et al.
2005/0081852 A1 4/2005 Rangachari
2005/0121044 A1 6/2005 Banerjee et al.
2005/0150492 A1 7/2005 Dunkley et al.
2007/0012327 A1 1/2007 Karles et al.
2007/0186945 A1 8/2007 Olegario et al.
2008/0092912 A1 * 4/2008 Robinson ..... A24D 1/20 131/200
2010/0101589 A1 4/2010 Nelson et al.
2010/0154808 A1 6/2010 Boll et al.
2011/0126848 A1 6/2011 Zuber et al.
2012/0118309 A1 5/2012 Taniguchi
2013/0042865 A1 2/2013 Monsees
2013/0068081 A1 3/2013 Kronberg et al.
2013/0121608 A1 5/2013 Winnemoeller et al.
2013/0192615 A1 8/2013 Tucker et al.
2013/0192616 A1 8/2013 Tucker et al.
2013/0192619 A1 8/2013 Tucker et al.
2013/0192620 A1 8/2013 Tucker et al.
2013/0192621 A1 8/2013 Li et al.
2013/0192622 A1 8/2013 Tucker et al.
2013/0192623 A1 8/2013 Tucker et al.
2013/0298905 A1 11/2013 Levin et al.
2013/0312742 A1 11/2013 Monsees et al.
2014/0060554 A1 3/2014 Collett et al.
2014/0202478 A1 7/2014 Awty et al.
2014/0202479 A1 7/2014 Nicholls et al.
2014/0261475 A1 9/2014 Kizer et al.
2014/0261486 A1 9/2014 Potter et al.
2014/0326260 A1 11/2014 Gladden et al.
2015/0027468 A1 1/2015 Li et al.
2015/0027469 A1 1/2015 Tucker et al.
2015/0027477 A1 1/2015 Yoshino et al.
2015/0083150 A1 * 3/2015 Conner ..... A24D 1/22 131/360
2015/0245654 A1 9/2015 Memari et al.
2015/0245655 A1 9/2015 Memari et al.
2015/0245656 A1 9/2015 Memari et al.
2015/0245657 A1 9/2015 Memari
2015/0245662 A1 9/2015 Memari et al.
2015/0245663 A1 9/2015 Memari et al.
2015/0245664 A1 9/2015 Memari et al.
2015/0245665 A1 9/2015 Memari et al.
2015/0245666 A1 9/2015 Memari et al.
2015/0245667 A1 9/2015 Memari et al.
2015/0245668 A1 9/2015 Memari et al.
2015/0296881 A1 10/2015 Hartrick et al.
2015/0313281 A1 * 11/2015 Bonici ..... A24D 1/22 131/330
2015/0359266 A1 12/2015 Memari et al.
2015/0374035 A1 12/2015 Sanchez
2016/0007648 A1 1/2016 Sutton et al.
2016/0037824 A1 2/2016 Jordil
2016/0073684 A1 3/2016 Mironov et al.
2016/0206004 A1 7/2016 Shinkawa et al.
2017/0347706 A1 12/2017 Aoun et al.
2017/0360088 A1 12/2017 Pijnenburg et al.
2018/0007974 A1 * 1/2018 Thorens ..... A61M 15/003
2018/0027882 A1 2/2018 Hepworth et al.
2018/0279678 A1 10/2018 Hepworth et al.
2018/0352856 A1 12/2018 Sebastian et al.
2018/0360122 A1 12/2018 Aoun et al.
2019/0098930 A1 4/2019 Fallon et al.
2019/0125988 A1 5/2019 Trzecieski
2019/0230990 A1 8/2019 Hepworth
2019/0254344 A1 8/2019 Hepworth et al.
2019/0254345 A1 8/2019 Hepworth et al.
2019/0274350 A1 9/2019 Duc
2020/0046026 A1 2/2020 Pijnenburg et al.
2020/0060333 A1 2/2020 Sutton et al.
2020/0138009 A1 5/2020 Schultheiss et al.
2020/0390149 A1 12/2020 Hepworth et al.

FOREIGN PATENT DOCUMENTS

AU 2013214984 A1 8/2014
AU 2013214987 A1 8/2014
AU 2013214991 A1 8/2014
AU 2013214993 A1 8/2014
AU 2013214994 A1 8/2014
AU 2013214997 A1 8/2014
AU 2013214998 A1 8/2014
CA 2845090 A1 2/2013
CA 2862105 A1 8/2013
CA 2862294 A1 8/2013

(56) References Cited

FOREIGN PATENT DOCUMENTS

| | | | |
|---|---|---|---|
| CA | 2863185 | A1 | 8/2013 |
| CA | 2863189 | A1 | 8/2013 |
| CA | 2867620 | A1 | 8/2013 |
| CA | 2867624 | A1 | 8/2013 |
| CA | 2868313 | A1 | 8/2013 |
| CN | 2760984 | Y | 3/2006 |
| CN | 104219973 | A | 12/2014 |
| CN | 104244749 | A | 12/2014 |
| CN | 104244750 | A | 12/2014 |
| CN | 104284606 | A | 1/2015 |
| CN | 104302197 | A | 1/2015 |
| CN | 104394722 | A | 3/2015 |
| CN | 204275207 | U | 4/2015 |
| CN | 104661544 | A | 5/2015 |
| CN | 204560971 | U | 8/2015 |
| CN | 104968225 | A | 10/2015 |
| DE | 60310596 | T2 | 10/2007 |
| EA | 201490448 | A1 | 12/2014 |
| EP | 0636324 | A1 | 2/1995 |
| EP | 1555899 | B1 | 12/2006 |
| EP | 2083643 | | 8/2009 |
| EP | 2723429 | A1 | 4/2014 |
| EP | 2727619 | A2 | 5/2014 |
| EP | 2740506 | A1 | 6/2014 |
| EP | 2740507 | A1 | 6/2014 |
| EP | 2740508 | A1 | 6/2014 |
| EP | 2727619 | A3 | 7/2014 |
| EP | 2756859 | A1 | 7/2014 |
| EP | 2756860 | A1 | 7/2014 |
| EP | 2809180 | A1 | 12/2014 |
| EP | 2809182 | A2 | 12/2014 |
| EP | 2809183 | A1 | 12/2014 |
| EP | 2809184 | A1 | 12/2014 |
| EP | 2809185 | A1 | 12/2014 |
| EP | 2809186 | A1 | 12/2014 |
| EP | 2809187 | A1 | 12/2014 |
| EP | 2723429 | A4 | 4/2015 |
| EP | 2809180 | A4 | 7/2015 |
| EP | 2809184 | A4 | 7/2015 |
| EP | 2809187 | A4 | 7/2015 |
| EP | 2809182 | A4 | 8/2015 |
| EP | 2809183 | A4 | 8/2015 |
| EP | 2809185 | A4 | 8/2015 |
| EP | 2809186 | A4 | 9/2015 |
| EP | 2948006 | A1 | 12/2015 |
| EP | 2964038 | A1 | 1/2016 |
| EP | 2975956 | A1 | 1/2016 |
| EP | 3039972 | A1 | 7/2016 |
| GB | 2394394 | A | 4/2004 |
| GB | 201413018 | | 9/2014 |
| GB | 201413019 | | 9/2014 |
| GB | 201413021 | | 9/2014 |
| GB | 201413025 | | 9/2014 |
| GB | 201413027 | | 9/2014 |
| GB | 201413028 | | 9/2014 |
| GB | 201413030 | | 9/2014 |
| GB | 201413032 | | 9/2014 |
| GB | 201413034 | | 9/2014 |
| GB | 201413036 | | 9/2014 |
| GB | 201413037 | | 9/2014 |
| GB | 2513061 | A | 10/2014 |
| GB | 2523585 | A | 9/2015 |
| GB | 2523585 | A8 | 9/2015 |
| GB | 2525080 | A | 10/2015 |
| GB | 2525294 | A | 10/2015 |
| GB | 2525295 | A | 10/2015 |
| GB | 2525480 | A | 10/2015 |
| GB | 2525722 | A | 11/2015 |
| GB | 2525723 | A | 11/2015 |
| GB | 2525724 | A | 11/2015 |
| GB | 2525725 | A | 11/2015 |
| GB | 2525726 | A | 11/2015 |
| GB | 2525727 | A | 11/2015 |
| GB | 2529919 | A | 3/2016 |
| GB | 2531633 | A | 4/2016 |
| HK | 1197203 | A1 | 1/2015 |
| HK | 1198138 | A1 | 3/2015 |
| HK | 1198142 | A1 | 3/2015 |
| HK | 1198143 | A1 | 3/2015 |
| HK | 1200128 | A1 | 7/2015 |
| HK | 1200129 | A1 | 7/2015 |
| HK | 1203128 | A1 | 10/2015 |
| IL | 233651 | | 8/2014 |
| IL | 233896 | | 9/2014 |
| IL | 230930 | A | 6/2017 |
| IL | 233851 | A | 6/2019 |
| IL | 233653 | A | 4/2020 |
| IL | 233885 | A | 5/2020 |
| IL | 233894 | A | 5/2020 |
| IL | 233895 | A | 5/2020 |
| JP | S4991583 | U | 8/1974 |
| JP | S5736898 | U | 2/1982 |
| JP | S6033891 | U | 3/1985 |
| JP | S60127794 | U | 8/1985 |
| JP | H022331 | A | 1/1990 |
| JP | H05211861 | A | 8/1993 |
| JP | 2006503572 | A | 2/2006 |
| JP | 2010506594 | A | 3/2010 |
| JP | 2010536336 | A | 12/2010 |
| JP | 2012507287 | A | 3/2012 |
| JP | 2014524313 | A | 9/2014 |
| JP | 2014532433 | A | 12/2014 |
| JP | 2015503335 | A | 2/2015 |
| JP | 2015505474 | A | 2/2015 |
| JP | 2015505475 | A | 2/2015 |
| JP | 2015505476 | A | 2/2015 |
| JP | 2015506182 | A | 3/2015 |
| JP | 2015508641 | A | 3/2015 |
| JP | 2015512617 | A | 4/2015 |
| JP | 2015513393 | A | 5/2015 |
| JP | 2015518730 | A | 7/2015 |
| JP | 2015523089 | A | 8/2015 |
| JP | 2015536154 | A | 12/2015 |
| JP | 2016509852 | A | 4/2016 |
| JP | 2016510994 | A | 4/2016 |
| JP | 2016517701 | A | 6/2016 |
| JP | 2016523565 | A | 8/2016 |
| JP | 2018166509 | A | 11/2018 |
| KR | 20140070543 | A | 6/2014 |
| KR | 20140090138 | A | 7/2014 |
| KR | 20140125822 | A | 10/2014 |
| KR | 20140125827 | A | 10/2014 |
| KR | 20140125828 | A | 10/2014 |
| KR | 20140125829 | A | 10/2014 |
| KR | 20140127288 | A | 11/2014 |
| KR | 20150003845 | A | 1/2015 |
| KR | 20150005514 | A | 1/2015 |
| KR | 20150035488 | A | 4/2015 |
| KR | 20160098203 | A | 8/2016 |
| MA | 20150054 | A1 | 2/2015 |
| MA | 20150055 | A1 | 2/2015 |
| MA | 20150056 | A1 | 2/2015 |
| MA | 20150057 | A1 | 2/2015 |
| MA | 20150058 | A1 | 2/2015 |
| MA | 20150153 | A1 | 5/2015 |
| MA | 20150169 | A1 | 6/2015 |
| MX | 2014009396 | A | 2/2015 |
| MX | 2014009398 | A | 2/2015 |
| MX | 2014009393 | A | 5/2015 |
| MX | 2014009394 | A | 5/2015 |
| MX | 2014009397 | A | 5/2015 |
| NL | 8301145 | A | 11/1983 |
| NZ | 627439 | A | 9/2015 |
| NZ | 628058 | A | 1/2016 |
| RU | 157882 | U1 | 12/2015 |
| RU | 2581999 | C2 | 4/2016 |
| SG | 2014013627 | A | 7/2014 |
| TW | 201315397 | A | 4/2013 |
| WO | WO-2010045671 | A1 | 4/2010 |
| WO | 2011077138 | A1 | 6/2011 |
| WO | WO-2012156695 | A1 | 11/2012 |
| WO | WO-2013020280 | A1 | 2/2013 |
| WO | WO-2013025921 | A1 | 2/2013 |
| WO | WO-2013068081 | A1 | 5/2013 |

(56) References Cited

FOREIGN PATENT DOCUMENTS

| | | | |
|---|---|---|---|
| WO | WO-2013068100 | A1 | 5/2013 |
| WO | WO-2013098405 | A2 | 7/2013 |
| WO | 2013121698 | A1 | 8/2013 |
| WO | WO-2013116558 | A1 | 8/2013 |
| WO | WO-2013116561 | A1 | 8/2013 |
| WO | WO-2013116565 | A1 | 8/2013 |
| WO | WO-2013116567 | A1 | 8/2013 |
| WO | WO-2013116568 | A2 | 8/2013 |
| WO | WO-2013116571 | A1 | 8/2013 |
| WO | WO-2013116572 | A1 | 8/2013 |
| WO | WO-2013120566 | A2 | 8/2013 |
| WO | WO-2013121608 | A1 | 8/2013 |
| WO | WO 2013138384 | | 9/2013 |
| WO | WO-2013138384 | A3 | 10/2013 |
| WO | WO-2013156339 | A1 | 10/2013 |
| WO | 2013164630 | A1 | 11/2013 |
| WO | WO-2013179524 | A1 | 12/2013 |
| WO | WO-2014116974 | A1 | 7/2014 |
| WO | WO 2014140273 | | 9/2014 |
| WO | 2014157051 | A1 | 10/2014 |
| WO | WO-2014158051 | A1 | 10/2014 |
| WO | WO-2014159250 | A1 | 10/2014 |
| WO | WO-2013116568 | A3 | 11/2014 |
| WO | WO 2014184239 | | 11/2014 |
| WO | WO 2015013108 | | 1/2015 |
| WO | WO-2015013108 | A3 | 4/2015 |
| WO | WO-2015047954 | A1 | 4/2015 |
| WO | WO-2015128665 | A1 | 9/2015 |
| WO | WO-2015128666 | A1 | 9/2015 |
| WO | WO-2015128667 | A1 | 9/2015 |
| WO | WO-2016024083 | A1 | 2/2016 |
| WO | WO-2016076178 | A1 | 5/2016 |
| WO | WO-2016084120 | A1 | 6/2016 |
| WO | WO 2016135342 | | 9/2016 |
| WO | WO-2017149152 | A1 | 9/2017 |
| WO | WO-2017160559 | A1 | 9/2017 |
| WO | 2017198838 | A1 | 11/2017 |

OTHER PUBLICATIONS

Application and File History for U.S. Appl. No. 16/333,570, filed Mar. 24, 2019, Inventor: Hepworth et al.
Application and File History for U.S. Appl. No. 16/333,567, filed Mar. 24, 2019, Inventor: Hepworth et al.
Application and File History for U.S. Appl. No. 16/333,568, filed Mar. 24, 2019, Inventor: Hepworth et al.
Communication pursuant to Article 94(3) EPC for Application No. 1778008.3, mailed Sep. 11, 2020, 8 pages.
International Preliminary Report on Patentability for Application No. PCT/EP2017/073057, mailed on Mar. 28, 2019, 9 pages.
International Preliminary Report on Patentability for Application No. PCT/EP2017/072811, mailed on Aug. 20, 2018, 7 pages.
International Preliminary Report on Patentability for Application No. PCT/EP2017/072814, mailed on Nov. 30, 2018, 8 pages.
International Preliminary Report on Patentability for Application No. PCT/EP2017/072813, mailed on Nov. 30, 2018, 9 pages.
International Preliminary Report on Patentabilityfor Application No. PCT/EP2017/073061, mailed Mar. 28, 2019, 7 pages.
International Search Report and Written Opinion for Application No. PCT/EP2017/072811, mailed on Dec. 11, 2017, 15 pages.
International Search Report and Written Opinion for Application No. PCT/EP2017/072813, mailed on Dec. 11, 2017, 12 pages.
Application for U.S. Appl. No. 16/333,563, filed Mar. 14, 2019, inventors Hepworth et al.
International Search Report and Written Opinion for Application No. PCT/EP2017/072814, mailed on Dec. 11, 2017, 12 pages.
International Search Report and Written Opinion for Application No. PCT/EP2017/073061, mailed Jan. 8, 2018, 13 pages.
Korean Office Action mailed Oct. 26, 2020 for Korean Application No. 10-2019-7010642 27 pages.
Korean Office Action mailed Oct. 26, 2020 for Korean Application No. 10-2019-7010644, 21 pages.
Notice of Reasons for Rejection for Japanese Application No. 2019-535975, dated Jul. 7, 2020, 9 pages.
Office Action For Korean Application No. 10-2019-7010649, mailed on Jan. 19, 2021, 7 pages.
Office Action mailed Feb. 2, 2021 for Japanese Application No. JP2019-513828, 7 pages.
Office Action mailed Aug. 20, 2020 for Russian Application No. 2019107330, 13 pages.
Office Action mailed Jul. 21, 2020 for European Application No. 17780009.1, 7 pages.
Office Action mailed Jul. 21, 2020 for Japanese Application No. 2019-513761, 11 pages.
Office Action mailed Jul. 21, 2020 for Japanese Application No. 2019-513827, 9 pages.
Office Action mailed Jul. 21, 2020 for Japanese Application No. 2019-513842, 11 pages.
Office Action mailed Jul. 7, 2020 for Japanese Application No. JP2019-513828, 12 pages.
Search Report mailed Mar. 2, 2018 for Great Britain Application No. GB1615609.3, 4 pages.
Office Action for Japanese Application No. 2019-535975, mailed on Oct. 19, 2021, 4 pages.
Notice of Reasons for Refusal for Japanese Application No. 2019-535975, mailed on Apr. 12, 2022, 18 pages.
"Communication of Notice of Opposition received for European Patent Application No. 17780311.1, mailed on Jan. 17, 2023", 1 page.
"Communication pursuant to Rule 114(2) EPC received for European patent Application No. 17780630.4, mailed on Jun. 28, 2021", 9 pages.
"Office Action received for Japanese Patent Application No. 2019-535975, mailed on Mar. 9, 2021", 2 pages (English Copy Only).
"Office Action received for Korean Patent Application No. 10-2021-7912725, mailed on Nov. 25, 2021", 6 pages (3 pages of English Translation and 3 pages of Official Copy).
File Note: Paper Filters/302, S. Wahal, Research and Development, Brown & Williamson Tobacco Corporation, dated Dec. 6, 1993, retrieved from USCF Library, Industry Documents Library at industrydocuments.uscf.edu/docs/ #id=mtmb0140, 20 pages.
Report No. 85632 on Experiment No. 158, United States Testing Company, Inc., dated Oct. 8, 1954, retrieved from USCF Library, Industry Documents Library at industrydocuments.uscf.edu/docs/ #id=pnvn0109, 3 pages.
Wikipedia entry for "Crepe paper" from Aug. 28, 2015 at 01:07, retrieved from https://en.wikipedia.org/w/index.php? title=Crepe_parper&oldid=678212842, 2 pages.

* cited by examiner

CONTAINER FOR AN AEROSOL PROVISION DEVICE

PRIORITY CLAIM

The present application is a National Phase entry of PCT Application No. PCT/EP2017/073057, filed Sep. 13, 2017, which claims priority from GB Patent Application No. 1615608.5, filed Sep. 14, 2016, which is hereby fully incorporated herein by reference.

TECHNICAL FIELD

The present invention relates to a container, and more particularly to a container for an apparatus for generating an inhalable material.

BACKGROUND

Smoking articles such as cigarettes, cigars and the like burn tobacco during use to create tobacco smoke. Attempts have been made to provide alternatives to these articles that burn tobacco by creating products that release compounds without burning.

Examples of such products are heating devices which release compounds by heating, but not burning, the material. The material may be for example tobacco or other non-tobacco products, which may or may not contain nicotine.

As another example, there are so-called e-cigarette devices. These devices typically contain a liquid which is heated to vaporize the liquid to produce an inhalable vapor or aerosol. The liquid may contain nicotine and/or flavorings and/or aerosol-generating substances, such as glycerol. The known e-cigarette devices typically do not contain or use tobacco.

SUMMARY

According to a first aspect of the present invention, there is provided a container for an aerosol provision device for providing an inhalable medium comprising an aerosol, the container comprising: a first section and second and third sections either side of the first section, wherein the first section and the second and third sections each comprises a respective material that permits the aerosol generated in the device to flow into and through the container and wherein a first substance is distributed in the material of the first section, the first substance for modifying a property of the aerosol when the aerosol flows through the container and wherein the material of at least one of the second and third sections is substantially free of the first substance and acts as a barrier to prevent first substance exiting the container.

According to a second aspect of the invention, there is provided a container for an aerosol provision device, the container comprising: a first section that comprises cut rag tobacco that has a density that is in the range of 150 to 500 mg/cm$^3$ for imparting flavor to an aerosol generated in the aerosol provision device and which, in use, flows through the first section; a second section at one side of the first section, wherein the second section comprises a material that permits the vapor and/or aerosol generated in the device to flow there through and acts as a barrier to prevent tobacco from the cut rag tobacco exiting the container.

According to a third aspect of the invention, there is provided a container for an aerosol provision device for providing an inhalable medium comprising an aerosol, the flavor container comprising: a first section containing a first substance for modifying a property of the aerosol generated in the device and which aerosol, in use, flows through the first section; a second section at one side of the first section, wherein the second section comprises a material that defines a multiplicity of elongate flow channels that permit the aerosol generated by the device to flow there through and wherein the second section is substantially free of the first substance and acts as a barrier to prevent first substance exiting the container.

Further features and advantages of the invention will become apparent from the following description of preferred embodiments of the invention, given by way of example only, which is made with reference to the accompanying drawings. Like features appearing in different ones of the drawings are giving the same reference numerals in the different drawings.

DETAILED DESCRIPTION

Figure 1:
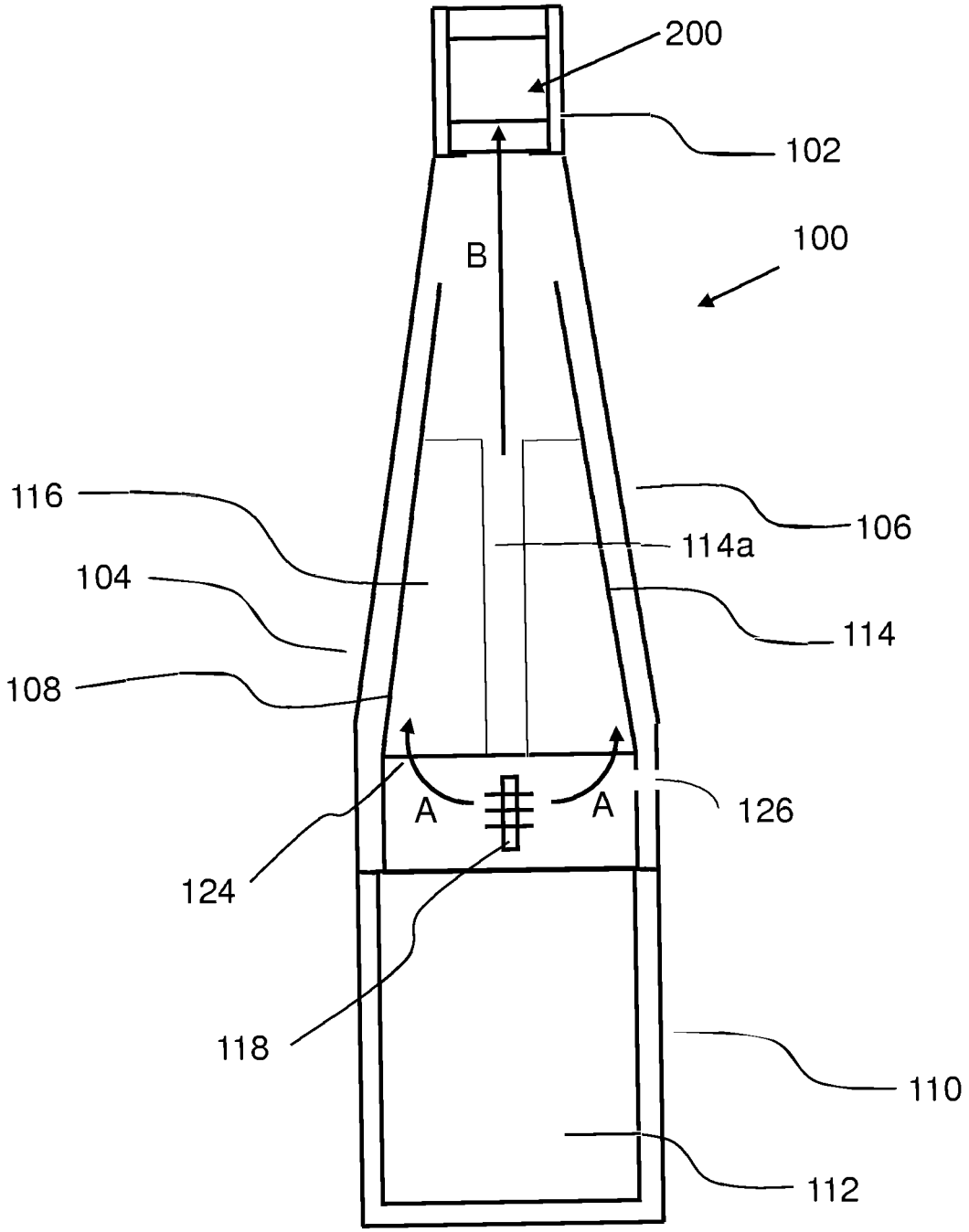
FIG. 1 shows a schematic of an exemplary aerosol provision device.

Referring to FIG. 1, a schematic of an aerosol provision device 100 is illustrated. The aerosol provision device 100 is an inhalation device (i.e. a user uses it to inhale an aerosol provided by the device) and the device 100 is a hand held device. In this example, the device 100 is an electronic cigarette 100. In broad outline, the device 100 volatilizes a liquid to form a vapor or an aerosol which passes through a flavor container 200 received in a mouthpiece 102 of the device 100. The flavor container 200 imparts a flavor to the vapor or aerosol passing through the mouthpiece 102 for inhalation by a user.

In this respect, first it may be noted that, in general, a vapor is a substance in the gas phase at a temperature lower than its critical temperature, which means that for example the vapor can be condensed to a liquid by increasing its pressure without reducing the temperature. On the other hand, in general, an aerosol is a colloid of fine solid particles or liquid droplets, in air or another gas. A colloid is a substance in which microscopically dispersed insoluble particles are suspended throughout another substance. For reasons of convenience, as used herein the term aerosol should be taken as meaning an aerosol, a vapor or a combination of an aerosol and vapor.

Returning to FIG. 1, the device 100 comprises an outer body 104 comprising an upper portion 106 housing a cartridge 108 and a lower portion 110 housing a battery portion 112. The cartridge 108 is connected to, but removable from, the battery portion 112. In this example, at least the upper portion 106 of the outer body 104 may be removed so as to expose the cartridge 108, and hence allow installation, removal and/or replacement of the cartridge 108. The cartridge 108 has a liquid container 114 for containing e-cigarette liquid 116.

The device 100 has the mouthpiece 102 removably connected to the upper portion 106 of the outer body 104. The mouthpiece 102 has received therein the flavor container 200 for imparting a flavor to a flow of aerosol or vapor that passes through the mouthpiece 102. Examples of flavor elements 200 will be discussed in more detail below.

The device 100 is arranged so that as the liquid 116 is volatilized so as to produce an aerosol of liquid droplets or sufficiently heated to produce a vapor, at least some and preferably all or substantially all of the aerosol or vapor passes through the flavor container 200 received in the mouthpiece 102 for example so as to entrain constituents of the flavor container 200 therein. In at least some examples a vapor is produced that then at least partly condenses to form an aerosol before exiting the device 100.

The liquid container 114 is provided generally centrally of the cartridge 108. The liquid container 114 is frusto-conical in shape, but may have a different shape, such as conical, cylindrical, etc. The liquid container 114 is annular in shape and defines a cylindrical channel 114*a* running through the length of the liquid container 114. The liquid container 114 may be formed of rigid, watertight and airtight materials, such as metal, suitable plastics, etc.

The cartridge 108 is provided with a heater 118 and a wick (not shown) in (thermal) contact with the heater 118. In this example, the heater 118 and the wick are provided as a single unit, sometimes known as an "atomizer". In this case, where the cartridge 108 includes an atomizer, such a cartridge 108 is often referred to as a "cartomizer".

The orientation of the heater 118 is shown schematically and for example the heater 118 may be a coil having its longitudinal axis perpendicular or parallel to the longitudinal axis of the cartridge 108.

The wick (not shown) is in contact with the liquid 116. This may be achieved, for example, by the wick (not shown) being inserted through a through hole (not shown) in an end wall 124 of the liquid container 114. Alternatively or additionally, the end wall 124 may be a porous member which allows liquid to pass through from the liquid container 114, and the wick (not shown) may be in contact with the porous end wall 124. The end wall 124 may be for example in the form of a porous ceramic disk. A porous end wall 124 of this type helps to regulate the flow of liquid onto the wick (not shown). The wick (not shown) is generally absorbent and acts to draw in liquid 116 from the liquid container 114 by capillary action (shown schematically in FIG. 1 by arrows A). The wick is preferably non-woven and may be for example a cotton or wool material or the like, or a synthetic material, including for example polyester, nylon, viscose, polypropylene or the like, or a ceramic material.

The cartridge 104 is (electrically) connected to a battery in the battery portion 112 to enable the heater 118 to be powered. When the heater 118 is powered (which may be instigated for example by the user operating a button (not shown) of the device 100 or by a puff detector (not shown) of the overall device 100, as is known per se), liquid 116 drawn (shown in FIG. 1 by arrows A) in from the liquid container 114 by the wick and is heated by the heater 110 to volatilize or vaporize the liquid, so as to generate at least one of a vapor and an aerosol.

In use, the liquid 116 may be heated to a temperature of between around 100-300° C. or more particularly around 150° C. to 250° C. The liquid 116 may, or may not, comprise nicotine.

As the user draws on the mouthpiece 102, air is drawn through an air inlet 126. The liquid 116 is volatized or vaporized by the heater 110 into the air from the air inlet 126 thereby to produce a flow of one of a vapor and an aerosol. The flow of vapor or aerosol is drawn through a channel 114*a* of the liquid container 114, through the flavor container 200 received in the mouthpiece 102, and out from the device 100 for inhalation by a user (this flow is shown by arrow B in FIG. 1).

The vapor or aerosol picks up (entrains) flavor (and/or other constituents) from the flavor container 200. One or more constituents of the flavor element is thereby mixed with the flow of at least one of a vapor and an aerosol thereby enhancing the sensory experience of a user.

FIGS. 2*a* to 2*g* each illustrates an example of a flavor container 200 that can be used in the device 100 as described above.

Figure 2A:
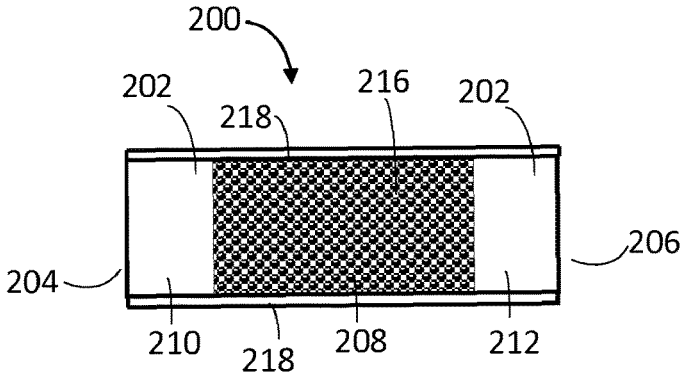
FIGS. 2*a* to 2*g* each a schematic sectional view of an example of a flavor container.

Referring first to FIG. 2*a*, in this example, the flavor container 200 comprises an elongate body of material 202 the composition of which is such that, when in use in the device 100, the vapor and/or aerosol stream generated in the device 100 is able to enter the flavor container 200 at an 'upstream' end 204, pass through the length of the flavor container 200, and exit the flavor container 200 at a 'downstream' end 206.

In some examples, the elongate body 202 comprises a fibrous material and may be, for example, a fibrous material that is typically used as a filter material in traditional cigarette, examples including cellulose acetate fibers, polypropylene fibers, polyester fibers and paper, including crimped paper. Other materials may be used for example, nylon and the like.

In this example, the elongate body of material 202 comprises a first middle or intermediate section 208, and two second and third end sections 210, 212, one either side of the middle section 208. In this example, the end section 210 is at the 'upstream' end 204 of the flavor container 200 and the end section 212 is at the 'downstream' end 206.

In this example, a first substance 216 which is a flavor component is distributed in the material in the middle section 208 but the material in the two end sections 210, 212 is substantially free of the first flavor component 216. In a preferred example, the first flavor component comprises a flavor material that has been ground or otherwise treated or formed so that it is in the form of particles, for example, powder, granules, grains, fibers, beads, pellets or the like so as, for example, to increase the active surface area or amount of the flavor material in order to maximize the amount of flavor imparted to a vapor and/or aerosol stream flowing through the flavor container 200. In one example, the particles are distributed substantially evenly throughout the material of the middle section 208.

In some examples, the first flavor component comprises tobacco although other botanicals or flavor agents may also be used.

Advantageously, the material of the two end sections 210, 212 each of which is substantially free of the first flavor component 216 causes the end sections 210, 212 to act as barriers that prevent fragments or particles of the first flavor component 216 exiting the flavor container 200. The end section 210 prevents flavor component 216 entering into the interior of the device 100 (where damage might be caused) and the end section 212 prevents flavor component 216 entering into the mouth of a user. This is particularly advantageous when the first flavor component 216 comprises particles of tobacco.

In one example, the material of the middle section 208 and the material in the two end sections 210, 212 comprises a continuous CA fiber formed into the elongate body of material 202 (e.g. the body of material 202 is what is known in the art as a 'dalmatian' type filter). In another example, the material of the middle section 208 and the material in the two end sections 210, 212 comprises a multiplicity of short cut CA fibers (e.g. fibers cut using a so called Turmalin apparatus) randomly orientated to form the elongate body of material 202.

Short cut CA fibers with for example ground tobacco as the first flavor component 126, may use just enough of the fibers to hold the ground tobacco in a rod form. Benefits of this arrangement allow for a lower pressure drop of vapor and/or aerosol flow and additionally there is reduced or no need for a plasticizer, for example, triacetine to hold the rod form as is required for a continuous fiber CA. Furthermore, use of short cut CA fibers enables the use of less CA and more tobacco than in the case of using a long continuous CA fiber.

In some examples the length of the middle section 208 is in the range 7 mm to 17 mm and preferably in the range 10 mm to 13 mm, the length of each of the end sections 210, 212 is in the range 3 mm to 15 mm and preferably in the range 4 mm to 6 mm and the diameter of the flavor container is in the range 5 mm to 8.5 mm.

In some examples the particles have an average diameter in the range of 0.1 mm to 3 mm, and preferably in the range of 0.3 mm to 2 mm.

In some examples, the weight of first flavor component present in the middle section 208 is 1 mg to 15 mg per mm of the middle section 208.

In the specific case of the material of the middle section comprising a continuous fiber and the first flavor component comprising ground tobacco the tobacco weight is preferably in the range of 2 mg to 6 mg per mm of the middle section 208.

In the specific case of the material of the middle section comprising short cut fibers and the first flavor component comprising ground tobacco the tobacco weight is preferably in the range of 6 mg to 15 mg per mm of the middle section 208.

In some examples, the percentage weight of first flavor component (and any other components e.g. charcoal, plasticizer) to the weight of the material of the middle section 208 is in the range 10% to 90% and preferably in the range 70% to 90%.

In the specific case of the material of the middle section comprising a continuous fiber and the first flavor component comprising ground tobacco the tobacco weight to the fiber weight is preferably in the range of 40% to 60% and most preferably in the range of 45% to 55%.

In the specific case of the material of the middle section comprising short cut fibers and the first flavor component comprising ground tobacco the tobacco weight to the fiber weight is preferably in the range of 75% to 95% and most preferably in the range of 80% to 90%.

The flavor container 200 may further comprise an outer wrapper layer 218 that surrounds the elongate body of material 202 along its length to provide additional structural security to the flavor container 200. The outer wrapper layer 218 may comprise any suitable material, for example, paper. In some examples, the outer wrapper layer 218 is configured so that its acts as a liquid resistant barrier that prevents liquid, for example, condensation that forms around the flavor container 200 when it is in use, from getting into the interior of the flavor container 200 and making the flavor container soggy. In one example, a liquid resistance wrapper layer 218 comprises paper impregnated with a barrier material or Natureflex or other suitable thin polymer film.

Although in the example illustrated in FIG. 2*a* both of the end sections 210, 212 are substantially free of the first flavor component 216, in other examples only one or other of the end sections 210, 212 is substantially free of the first flavor component 216 and thus acts as a barrier to prevent fragments or particles of the first flavor component 216 exiting the flavor container.

Figure 2B:
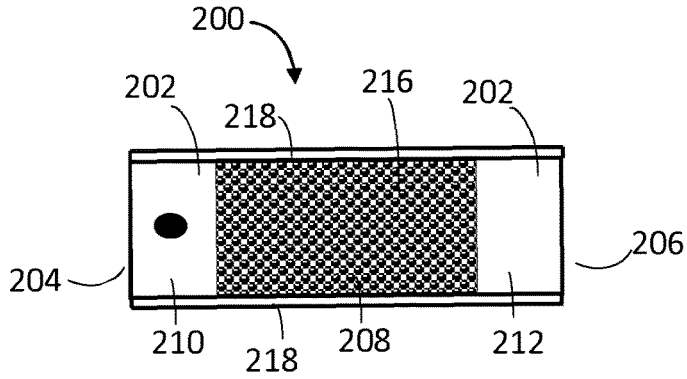
Figure 2C:
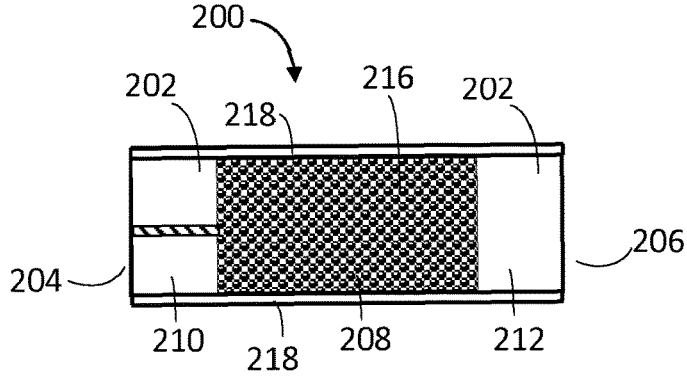
Figure 2D:
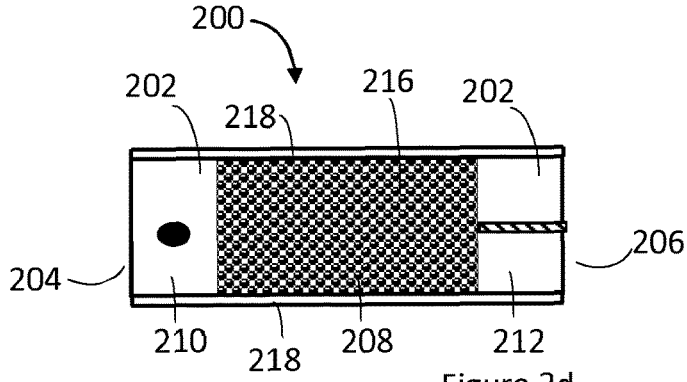

In some examples, at least one second additional substance which also may be a flavor component may be provided in one of, or both of, the two end sections 210, 212. The at least one additional flavor component may take any suitable form. For example, as is schematically illustrated in FIG. 2*b*, at least one flavor capsule 220 containing a flavor may be provided in the material of at least one of the two end sections 210, 212 (e.g. the end section 210 in FIG. 2*b*), or, as is schematically illustrated in FIG. 2*c*, at least one flavored thread or line 222 may be provided in the material of at least one of the two end sections 210, 212 (e.g. the end section 210 in FIG. 2*c*), or, as is schematically illustrated in FIG. 2*d*, or, as is schematically illustrated in FIG. 2*d*, a different additional flavor component may be placed in each of the end sections 210, 212 (e.g. a flavor capsule 220 in the end section 210 and a flavored thread or line 222 in the end section 212 as illustrated in FIG. 2*d*).

In other examples, the additional flavor component may be in an additional section (not shown) between either of the end sections 210, 212 and the middle section 208.

Figure 2E:
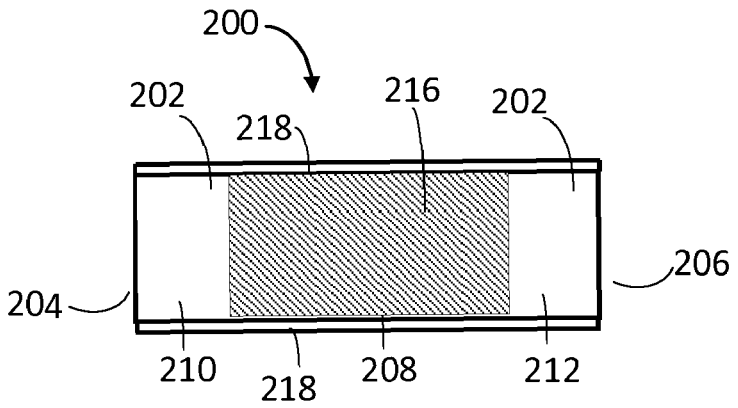

In an alternative example, as illustrated in FIG. 2*e*, the flavor container 200 comprises two end sections 210, 212, each comprising material as described above with respect to FIGS. 2*a* to 2*d* but, in contrast, in this example a middle section is free of the material of the end sections 210, 212 and instead comprises a portion of Tobacco cut rag 224 for imparting a flavor to a vapor and/or aerosol stream that flows through the length of the flavor container 200 when in use. Again, in this example, the material of the end sections 210, 212 is substantially free of tobacco and act as barriers to prevent tobacco exiting the flavor container 200. In some examples the density of the tobacco cut rag 224 is in the range of 150-500 mg per $cm^3$, preferably in the range 180-280 mg per $cm^3$, and most preferably in the range 200-250 mg per $cm^3$.

In a variation of the example of FIG. 2*e* the space between the end sections 210, 212 may be occupied fully or partially by ground tobacco rather than a cut tobacco rod. The ground tobacco may comprise particles having the average diameter discussed above.

Figure 2F:
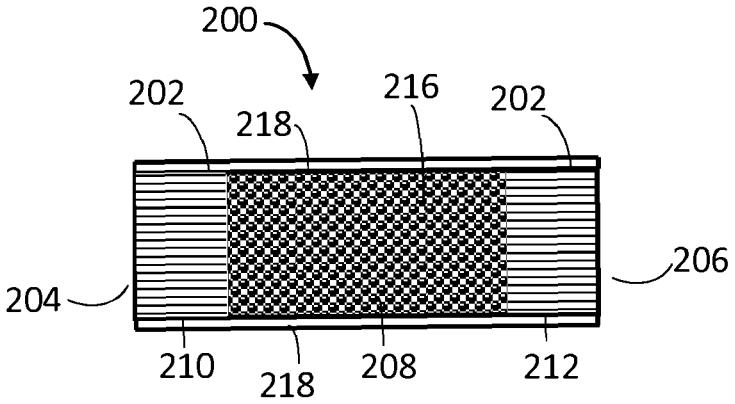

In an alternative example, as illustrated in FIG. 2*f*, the flavor container 200 comprises a middle section 208 comprising a material as described above with respect to FIGS. 2*a* to 2*d* but, in contrast to those examples, in this example, the two end sections 210, 212 each comprises a material that defines a multiplicity of elongate channels that run parallel to the longitudinal axis of the flavor container 200. In these examples, the two end sections 210, 212 may be thought of as a multi-channel lumen.

The material of the end sections 210, 212 is arranged so that the vapor and/or aerosol stream can flow through the elongate channels but fragments or particles of the first flavor component 216 cannot pass through the elongate channels (e.g. because the channels are too narrow) and hence are prevented from exiting the flavor container 200. In some examples, when the first flavor component comprises particles or fragments, the maximum cross sectional area of each channel is smaller than the average cross sectional area of the particles or fragments so as to prevent particles or fragments passing down the channels.

In some examples, the material of the end sections 210, 212 is a crimped material in which the material is formed into a series of parallel ridges that run parallel to the longitudinal axis of the flavor container 200 with each pair of adjacent ridges defining one of the channels.

In some examples the material comprises an extruded thermoplastic material, for example, Polylactic Acid (PLA) or polypropylene. In other examples, the material may comprise nylon.

In some examples, the material is moisture resistant so that the end sections 210, 212 maintain their shape in use.

In variations of the example shown in FIG. 2*f* (not illustrated), the space between the end sections 210, 212 may be occupied by a cut tobacco rod or fully or partially by ground tobacco as discussed with the example of FIG. 2*e*.

It will be appreciated also that one or other or both of the end sections 210, 212 in the examples of FIG. 2*e* and FIG. 2*f* may comprise a second flavor component as discussed in the examples of FIGS. 2*b* to 2*d*.

In all the described examples, the pressure difference across the flavor container 200 in use when a user takes a draw is preferably in the range of 5 to 40 mm water gauge (wg) and more preferably is in the range 10 to 30 mm wg. In some examples, the pressure difference across either of the end sections 210, 212 is in the range 0.1 mm to 2 mm wg per mm length of the section.

Figure 2G:
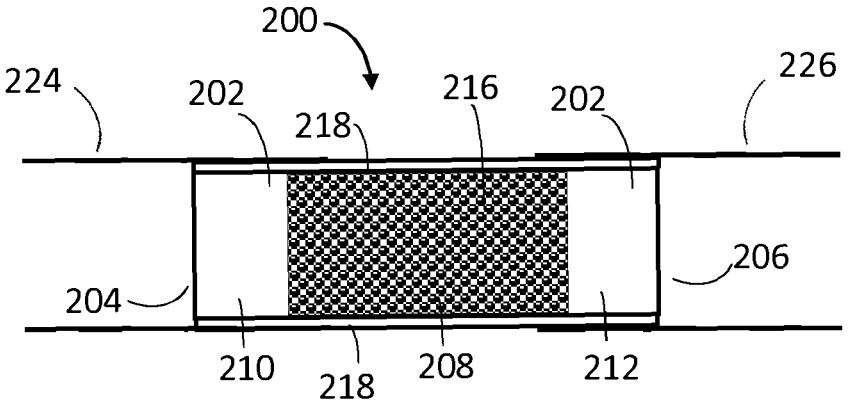
Figure 3:
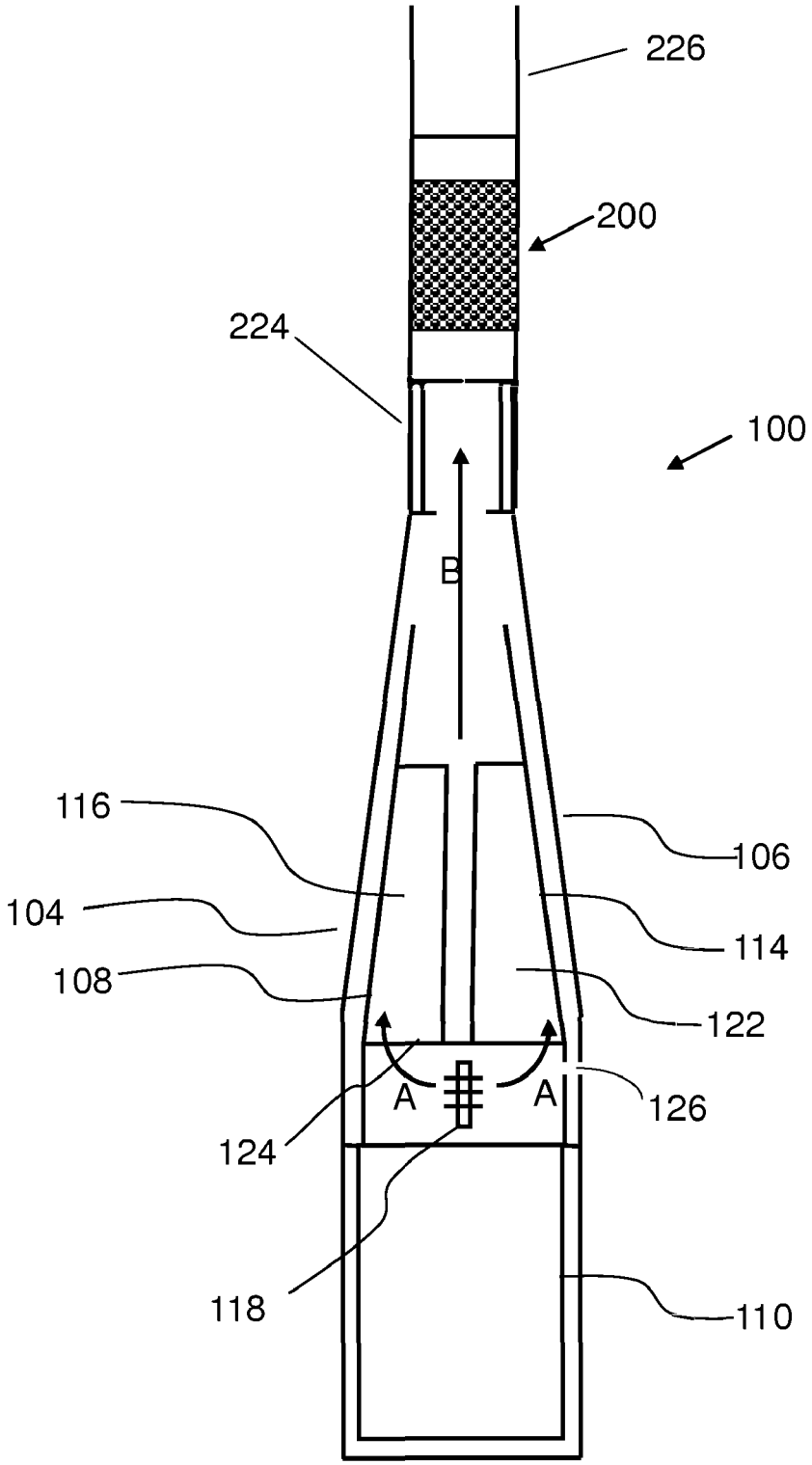
FIG. 3 shows a schematic of an exemplary aerosol provision device.

Referring now to FIG. 2*g*, in some examples, the flavor container may further comprise a hollow tube portion 224 extending from the region of the 'upstream' end 204 and/or a hollow tube portion 226 extending from the region of the 'downstream' end 206. If the hollow tube portion 224 extending from the region of the 'upstream' end 204 is present, then, as illustrated in FIG. 3, this may be used to affix the flavor container to the mouthpiece 102 of the smoking device 1. If the hollow tube portion 226 extending from the region of the 'downstream' end 206 is present, then, this tube portion 226 may itself be used as a mouthpiece by a user of the device 100. Either tube portion 224 or 226 may comprise any suitable material, for example, paper, cardboard, plastic or CA.

It is envisaged that after a certain number of draws, for example 20-50, the flavor of a flavor container 200 will be exhausted and at this point a user may replace a used flavor container 200 in a device 100 with a replacement flavor container 200. Replacement flavor containers 200 may of course be provided in packs. Each flavor container 200 may therefore be used over the course of multiple use sessions of the smoking device 1.

In some examples, sufficient liquid 116 is provided in the liquid container 114 to last multiple user sessions. In some examples, the liquid container 114 is arranged so that it can be re-filled or topped up with fresh liquid 116 by a user when the user so chooses. In other examples, a user cannot access the liquid container to 114 to add liquid to it and so in some examples, when the liquid 116 provided in the liquid container 114 is depleted or runs low a user may simply replace the used cartridge 108 with a new one.

In some examples, the cartridge 108 and the container 200 may be provided in combination together as a consumable that can be connected to, but removable from, the battery portion 112. This consumable may be designed to be a single session consumable (or at least limited number of sessions consumable) in that it contains sufficient liquid 116 and sufficient flavor substance in the container 200 to last a single user session (or limited number of user sessions) after which the user disposes of the consumable and replaces it with a new one.

Although in the examples described above, the container 200 is described as being a flavor container and contains a first substance 216 for modifying a flavor of the aerosol when the aerosol flows through the body of material, this is not essential and instead (or in addition) the first substance 216 may be for modifying a property of the aerosol other than (or in addition) to flavor.

In some examples, the first substance 216 may modify one or more other organoleptic properties of the aerosol (e.g. modifying the feel or smell or look of the aerosol to the user).

In some examples, the first substance 216 may be a substance that modifies the PH of the aerosol by either lowering or raising the PH (e.g. modifying the acidity or the basicity of the aerosol).

In some examples, the first substance 216 may modify (e.g. reduce) the amount of aldehydes in the aerosol.

In some examples, the first substance 216 may be a substance that modifies different combinations of two or more of these or indeed other properties of the aerosol.

Similarly, the at least one second additional substance may be a substance that modifies one or more of these properties indeed other properties of the aerosol.

Although in the above described examples, the device 100 generates the aerosol by heating a liquid (the device is of type commonly referred to as an e-cig), this is not essential and in other examples, the device may generate the aerosol by heating, but not burning, a material, that may contain for example tobacco (e.g. a device sometimes referred to as a Tobacco Heating Product (THP) device).

Indeed, in any of the examples, the device 100 may include any suitable material for generating the aerosol and be in any suitable form, for example, a gel.

It will be appreciated that the container 200 may be provided in packs containing multiple containers.

As used herein, the terms "flavor" and "flavorant" may refer to materials which, where local regulations permit, may be used to create a desired taste or aroma in a product for adult consumers. They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus *Mentha*), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, solid, or powder. For example, a liquid, oil, or other such fluid flavorant may be impregnated in a porous solid material so as to impart flavor and/or other properties to that porous solid material. As such, the liquid or oil is a constituent of the material in which it is impregnated.

The above embodiments are to be understood as illustrative examples of the invention. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. A flavor container for an aerosol provision device for modifying an inhalable medium comprising an aerosol, the flavor container comprising:

an elongate body of fibrous material, the elongate body of fibrous material comprising crimped paper and having a first section, a second section, and a third section, the second section and the third section arranged on either side of the first section, the elongate body of fibrous material being removably received in or attached to a mouthpiece such that the elongate body of fibrous material is in abutting or spaced apart relation downstream from generation of the aerosol within the aerosol provision device, wherein the fibrous material permits the aerosol generated in the aerosol provision device and upstream of the flavor container to flow into and through the flavor container, wherein a first substance is distributed in the fibrous material of the first section, the first substance for modifying a property of the previously generated aerosol when the aerosol flows through the flavor container, and wherein the fibrous material of each of the second section and the third section is substantially free of the first substance and acts as a barrier to prevent the first substance exiting the flavor container.

2. The flavor container of claim 1, wherein the fibrous material comprises at least one of cellulose acetate (CA), paper or Nylon.

3. The flavor container of claim 1, wherein a length of the first section is in a range of 7 mm to 17 mm.

4. The flavor container of claim 1, wherein a length of one or both of the second section or the third section is in a range of 3 mm to 15 mm.

5. The flavor container of claim 1, wherein a diameter of the flavor container is in a range of 5 mm to 8.5 mm.

6. The flavor container of claim 1, further comprising an outer wrapping layer.

7. The flavor container of claim 1, wherein the first substance is for modifying at least one of an organoleptic property of the aerosol, a flavor of the aerosol, or a pH of the aerosol.

8. The flavor container of claim 1, wherein the first substance comprises tobacco.

9. The flavor container of claim 8, wherein the tobacco is ground.

10. The flavor container of claim 8, wherein the tobacco comprises tobacco particles that have an average particle diameter in a range of 0.1 mm to 3 mm.

11. The flavor container of claim 1, wherein at least one additional substance for modifying a property of the aerosol when the aerosol flows through the flavor container is in at least one of the second section or the third section.

12. The flavor container of claim 11, wherein the at least one additional substance is for modifying at least one of an organoleptic property of the aerosol, a flavor of the aerosol, or a pH of the aerosol.

13. The flavor container of claim 12, wherein the at least one additional substance is one of: a strip of material, or is in a capsule.

14. The flavor container of claim 11, wherein the at least one additional substance is a flavor substance.

15. The flavor container of claim 1, further comprising a first tube portion extending from one of the second section or the third section.

16. The flavor container of claim 15, further comprising a second tube portion extending from the other of the second section or the third section.

17. An aerosol provision device for providing an inhalable medium of at least one of a vapor or an aerosol, the aerosol provision device comprising the flavor container of claim 1.

18. The aerosol provision device according to claim 17, further comprising:

a container for holding a liquid or a material; and a heater for at least one of:

volatilizing liquid held in the container to generate a flow of an aerosol in use, or heating but not combusting the material to generate a flow of an aerosol in use.

19. A system comprising the flavor container of claim 1 and a further container for containing a material from which the aerosol is generatable.

* * * * *